US006336478B2

(12) United States Patent
Puype et al.

(10) Patent No.: US 6,336,478 B2
(45) Date of Patent: Jan. 8, 2002

(54) SHED-FORMING DEVICE FOR A WEAVING MACHINE

(75) Inventors: Lode Puype, Waregem; Bram Vanderjeugt, Ypres, both of (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/745,935

(22) Filed: Dec. 26, 2000

(30) Foreign Application Priority Data

Dec. 23, 1999 (BE) ..... 09900833

(51) Int. Cl.[7] ..... D03C 3/06; D03C 3/12; D03C 3/20

(52) U.S. Cl. ..... 139/455

(58) Field of Search ..... 139/455

(56) References Cited

U.S. PATENT DOCUMENTS

| | | | | |
|---|---|---|---|---|
| 5,363,884 A | * | 11/1994 | Migliorini et al. | 139/455 |
| 5,671,784 A | * | 9/1997 | Dewispelaere | 139/455 |
| 5,881,777 A | | 3/1999 | Bassi et al. | |
| 5,996,648 A | | 12/1999 | Himmelstoss | |
| 6,058,983 A | * | 5/2000 | Bourgeaux et al. | 139/455 |

FOREIGN PATENT DOCUMENTS

| | | |
|---|---|---|
| DE | 29802064 | 4/1998 |
| EP | 0 723 041 | 7/1996 |
| EP | 0 851 048 | 7/1998 |
| EP | 0 899 367 | 3/1999 |
| EP | 0 930 384 | 7/1999 |
| FR | 2 648 159 | 12/1990 |
| GB | 2 300 650 | 11/1996 |

* cited by examiner

*Primary Examiner*—Andy Falik
(74) *Attorney, Agent, or Firm*—James Creighton Wray; Meera P. Narasimhan

(57) ABSTRACT

A shed-forming device, in particular an electronically controlled jacquard machine, with a number of combinations of at least two selection systems (3, 6 7), (5, 8, 9) respectively with selection elements provided one above the other. Each selection system comprises two hooks (6), (7), (8), (9) working together and that can be moved up and down by lifting device (13), (14) which can be selected by a selection element (3), (5). Hooks of different selection systems of a combination can be moved up and down, allowing for the use of simple selection elements. Two selection systems are provided per combination. This enables the number of selection systems with similar machine dimensions to be almost doubled in relation to the known devices. The hooks of selection systems of a same combination are movable by one and the same pair of lifting device (13), (14) and each lifting device (13), (14) has at least two parts for being able to engage respective hooks, well separated from one another, of different selection systems of the same combination.

14 Claims, 7 Drawing Sheets

SHED-FORMING DEVICE FOR A WEAVING MACHINE

BACKGROUND OF THE INVENTION

This invention relates to a shed-forming device for a weaving machine, comprising a number of combinations of at least two selection systems respectively with selection elements provided one above the other whereby each selection system comprises two hooks working together and that can be moved up and down by lifting means, which can be selected by a selection element so that they are held at a fixed height.

This invention more especially relates to an electronically controlled jacquard machine, in particular a two-position and a three-position open-shed jacquard machine, which is provided with selection systems with the above mentioned characteristics.

This invention finally also relates to a weaving machine provided with such a shed-forming device or jacquard machine.

Jacquard machines with selection systems are of course very well known. In the European patent publication EP 0 188 074 for example a selection and guiding device for the hooks of an electronically controlled two-position open-shed jacquard machine is described. The selection element is an electromagnet. The hooks are flexible and made out of ferromagnetic material. The electromagnet can bend the hooks to a first position whereby the hook is engaged by an up-and-down-moving knife, and to a second position whereby the hook hooks onto a projection (is selected) and is therefore held at a fixed height.

In this manner a hook can be allowed to move up and down at will or held at a fixed height.

It is generally known how in this manner the position of two hooks working together is determined and the warp yarns on a weaving machine can be brought by means of pulley cords and pulley elements, to two different heights according to the open-shed principle. It is furthermore also known how by means of two selection systems working together each with a pair of hooks and pulley elements working together three different positions can be achieved.

Furthermore from the Belgian patent no. 1 009 047 a three-position open-shed jacquard machine is known, of which each selection system comprises two electromagnetic coils placed one above the other. These coils are provided in order to act on two hooks working together that are implemented in two parts. The hooks can be moved up and down by two knife systems operating one above the other. This device can only operate as a three-position open-shed jacquard machine.

An important characteristic of a shed-forming device is the so-called footprint of each selection system, or in other words the surface area that one selection system occupies on a perpendicular projection of the device onto a horizontal plane.

The footprint is also the product of the pitch in the width and the pitch in the depth of the device, whereby "the pitch" is the width or the depth (in mm) of the area occupied by one selection system.

The above mentioned known jacquard machines can be implemented with a footprint of $8\times22$ mm$^2$. This is rather large. Because of this the number of selection systems per machine is limited and the dimensions of the machine become too large if the number of selection systems is increased.

SUMMARY OF THE INVENTION

A purpose of this invention is to remedy these disadvantages by providing a shed-forming device with a considerably smaller footprint, with which the number of selection systems per surface area unit can therefore be increased, and whereby the device can be implemented as desired in order to bring warp yarns into two positions or three positions.

From the European patent publication EP-0851048 a shed-forming device is known with combinations of two selection systems with selection elements provided one above the other, with which the number of selection systems per surface area unit can be increased.

This device however has a number of significant disadvantages. Each combination comprises two hook pairs of which the hooks belong to different selection systems of that combination. The hooks of each hook pair rest on one another and are lying against each other during their up- and downwards movements. For the selection of one hook of two hooks fitting against each other the respective selection elements must be provided with (through an electromagnet) positionable holding means that hook into a selection position in an opening of a hook. These selection elements must furthermore ensure a very accurate positioning of the holding means.

These selection means are consequently rather complex and expensive. An additional purpose of this invention is also to remedy this disadvantage.

The above mentioned aims are achieved with a shed-forming device that has the characteristics that are mentioned in the first paragraph of this specification, whereby the hooks of the various selection systems of a combination can be moved up and down separately from each other.

With such a shed-forming device two or more selection systems can be provided within almost the same footprint surface area as one selection system according to the state-of-the-art. If according to this invention for example two selection systems are provided per combination the footprint will be almost halved and the number of selection systems with similar machine dimensions will be almost doubled in relation to the known devices.

The device according to this invention can comprise shed-forming systems with which warp yarns can be brought into two different positions, but can also be so implemented that per combination two selection systems work together with each other in order to bring warp yarns into three different positions.

Since the hooks of different selection systems here can be moved completely independently and separately from each other they can also easily each be selected individually by means of a selection element that does not have to be able to position any holding means with great precision in order to operate efficiently. Such a selection element can therefore be made rather simple, and therefore inexpensively.

A purpose of this invention was to increase the number of selection systems per surface area unit. Each arrangement of selection elements at levels located one above the other that leads to that end corresponds to the invention idea. The significance of the expression "disposed one above the other" in this specification and in the claims attached hereto may therefore certainly not be interpreted as a restriction on the invention to selection elements disposed one above the other of which the vertical planes of symmetry almost converge or lie close to each other.

For a correct interpretation of this specification and of the claims attached hereto two selection elements must be considered as being "disposed one above the other" if they are disposed at a different height and if the vertical projections onto a horizontal plane of these selection elements at least partially overlap each other or lie next to each other with an intermediate distance that is smaller than the minimum intermediate distance between neighboring selection elements of a shed-forming device according state-of-the-art.

The shed-forming device according to this invention is preferably so implemented that the hooks of selection systems of a same combination are movable by one and the same pair of lifting means, and that each lifting means comprises at least two parts for engaging a respective hook of a different selection system of the same combination.

Thus for a same number of selection systems only half the number of lifting means are necessary in comparison to the known devices, while the hooks can be engaged well separated from one another by a same lifting means.

Preferably the aforesaid parts of each lifting means are provided at least at two different levels. The hooks of a same combination that can be engaged by a same lifting means can because of this be moved up and down still better separated from each other, and therefore without hindering each other.

According to a particular embodiment of this invention each lifting means comprises a passage through which hooks can traverse the lifting means.

Of the hooks of a same combination that can be engaged by a same lifting means one hook can extend downward from its top extremity through this passage to below the lifting means. This hook therefore has a part above the lifting means that is for example provided with means for being held at a fixed height when selected by a selection element and when not selected for resting on an engagement means of the lifting means, and a part below the lifting means that is provided, for example via pulley cords and pulley elements, for influencing the position of one or several warp yarns on a weaving machine.

The hooks that extend through the passage are guided herein during the course of their up- and downwards movements, and separated from the other hooks on the same lifting means.

In a particularly advantageous embodiment the device comprises at least one row of several combinations of two selection systems disposed next to each other, and the top and the bottom selection elements are disposed mutually shifted according to the direction of the row. With such a disposition the hooks selected by these selection elements are also disposed shifted and two shifted disposed hooks can be used for the two hooks working together of each selection system so that the pulley elements working together with these hooks occupy a position whereby their operating planes are oblique in relation to the direction of the aforesaid row.

Two pulley elements of a same combination can also be provided next to each other, with almost parallel operating planes, through a suitable selection of the hooks working together therewith or two pulleys can be brought into a position whereby their operating planes intersect each other.

According to a preferred embodiment each combination comprises a top and a bottom selection element with two opposite selection flanks for the selection of respective hooks, and the selection flanks of the bottom selection element lie closer together than the selection flanks of the top selection element.

A number of selection systems can be provided in order to bring warp yarns into two different positions and/or a number of sets of two selection systems (preferably selection systems that belong to the same combination) can be provided in order to work together in order to bring warp yarns into three different positions.

Each combination in a most preferred embodiment of this invention comprises two selection systems with a respective pair of hooks working together, whereby these hooks can be engaged by two lifting means capable of moving up and down in opposite phase, and whereby each lifting means comprises a top and a bottom engagement means for engaging a respective hook of a different pair of hooks working together of a same combination.

It is furthermore also preferred that the device is so implemented that it comprises at least one row of several combinations of two selection systems disposed next to each other, whereby the lifting means working together with these selection systems are provided in order to engage hooks of two combinations disposed next to each other. In this manner the device is constructed with a minimum number of lifting means.

According to a particular embodiment the device comprises at least one row of several combinations of selection systems disposed next to each other, of which each shed-forming system comprises at least one pulley element working together with the hooks, while the pulley elements of the selection systems that belong to a same combination are suspended next to each other or one below the other, and while the operating planes of the pulleys of these pulley elements are mutually almost parallel and are either transverse to the direction of the row or are oblique in relation to this direction.

The device furthermore preferably also comprises at least one row of several combinations of selection systems disposed next to each other, of which each selection system comprises at least one pulley element working together with the hooks, so that the operating planes of at least two pulleys that belong to a same combination intersect each other.

In the following detailed specification of an embodiment example of this invention the aforesaid characteristics and advantages of the invention are further explained and the additional properties and advantages thereof are indicated. The purpose of this specification is only to give a clarifying example of a number of possible embodiments according to this invention and can therefore in no way be interpreted as a restriction on the range of application of the invention or on the patent rights claimed in the claims.

BRIEF DESCRIPTION OF THE DRAWINGS

In this specification reference is made by means of reference numbers to the FIGS. 1 through 20 attached hereto, of which

DETAILED DESCRIPTION

Figure 1:
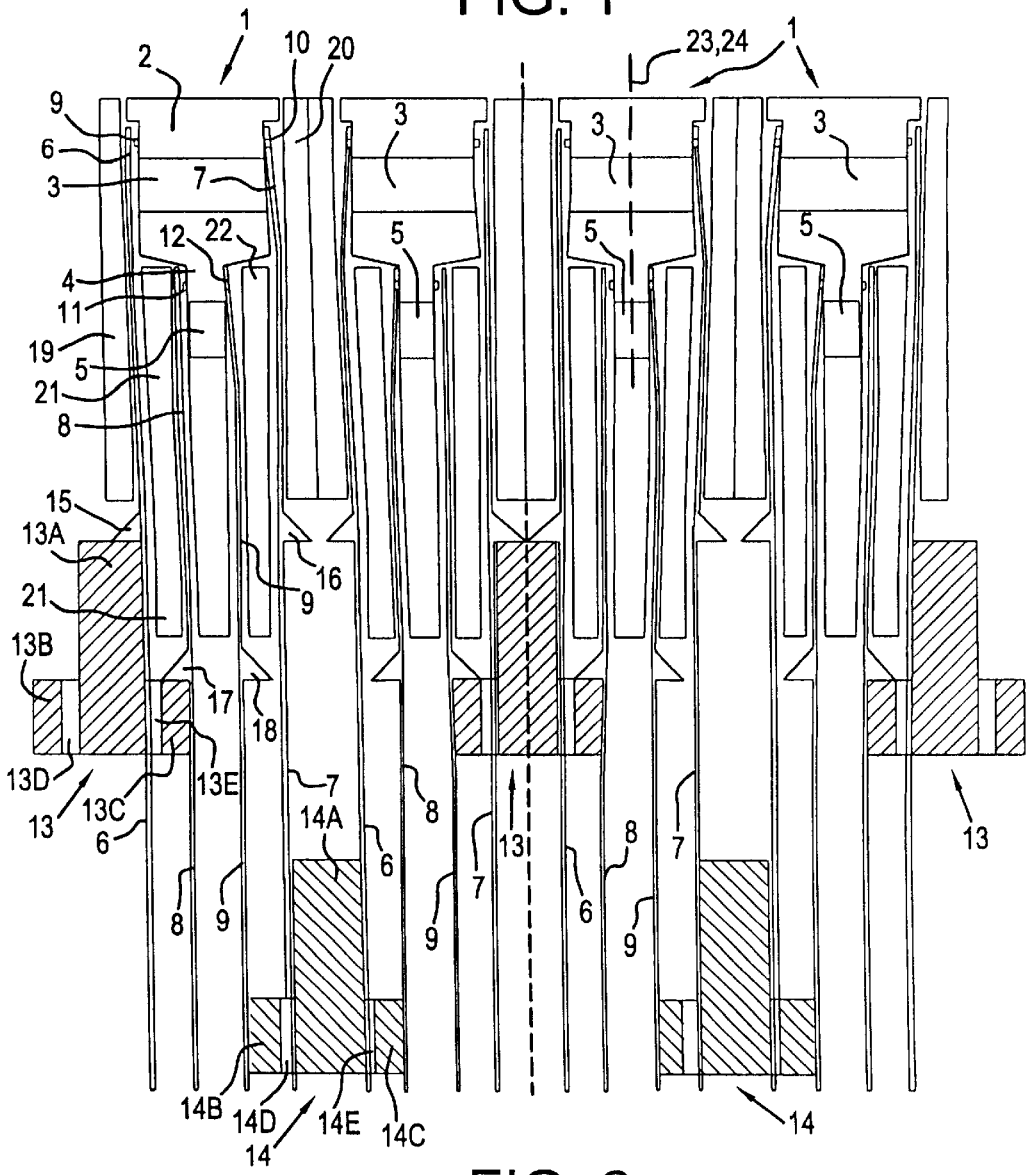
FIG. 1 represents a schematic side elevation of four combinations of two selection systems according to this invention disposed next to each other.

Each combination of two selection systems (see FIGS. 1 and 5 through 12) comprises a housing (1) with a top part (2) in which a top electromagnetic selection solenoid (3) is incorporated and a narrower bottom part (4) in which a bottom electromagnetic selection solenoid (4) is incorporated. On both sides of this housing (1) two hooks (6), (7); (8), (9) can be moved up and down by a respective knife (13), (14). The two knives (13), (14) can be moved up and down mutually in opposite phase.

Each selection solenoid (3), (5) is so disposed in the housing (1) that on two opposite flanks of the respective part (2), (4) of the housing (1) this can influence the position of a respective hook (6), (7), (8), (9) in order to select this or not. In this specification and in the claims these flanks are indicated by the term selection flanks. On each selection flank a projection (9), (10), (11), (12) is provided and each hook has an opening. With selection of a hook, the hook (6), (7), (8), (9) brought up by a knife (13), (14) is brought into a position by a selection solenoid (3), (5) whereby a projection (9), (10), (11), (12) provided on the housing is in the opening of the hook, so that this hook remains hooked onto this projection with the return downward movement of it s knife.

Each knife (13), (14) consists of a central part (13A), (14A) and on both sides thereof a wing part (13B), (13C); (14B), (14C) that is so connected to the central part that a gap (13D), (13E); (14D), (14E) is formed in each knife (13), (14) between this central part (13A), (14A) and each wing part (13B), (13C); (14B), (14C).

On each side of the housing (1) a long hook (6), (7) and a short hook (8), (9) can be moved up and down by a knife (13), (14). Each long hook (6), (7) can be moved up and down by a respective knife (13), (14) and moreover rests with a nose (15), (16) on an engagement edge of the central part (13A), (14A) of the knife (13), (14). Each short hook (8), (9) can be moved up and dow n by a respective knife (13), (14) and moreover rests with a nose (17), (18) on an engagement edge of one of the wing parts (13B), (14B) of the knife (13), (14).

The engagement edge of the central part (13A), (13B) of the knives (13), (14) is at a higher level than the engagement edges of the wings of these knives. In the top position of a knife the two long hooks (6), (7) engaged by this knife are on both sides of the housing (1) opposite the selection flanks of the top wider part (2) of this housing (1) so that they can be selected by th e top selection solenoid (3), and the two short hooks (8), (9) engaged by this knife are on both sides of the housing (1) opposite the selection flanks of the bottom narrower part (4) of this housing (1) so that they can be selected by the bottom selection solenoid (3). The long hooks (6), (7) extend downward through a respective gap on both sides of the central part (13A), (14A).

Opposite each hook (6), (7), (8), (9) a respective guiding element (19), (20), (21), (22) is disposed, so that each hook is guided during its up- and downwards movement opposite a selection flank of the housing (1) between this housing (1) and its guiding element (19), (20), (21), (22).

Each knife is provided in order to move a long (6), (7) and a short hook (8), (9) up and down of two combinations of selection systems located next to each other. The two short hooks (8), (9) moreover rest with their nose (17), (18) on a respective wing part while the two long hooks (8), (9) rest on two opposite engagement edges of the central part (13A), (14A).

Figure 2:
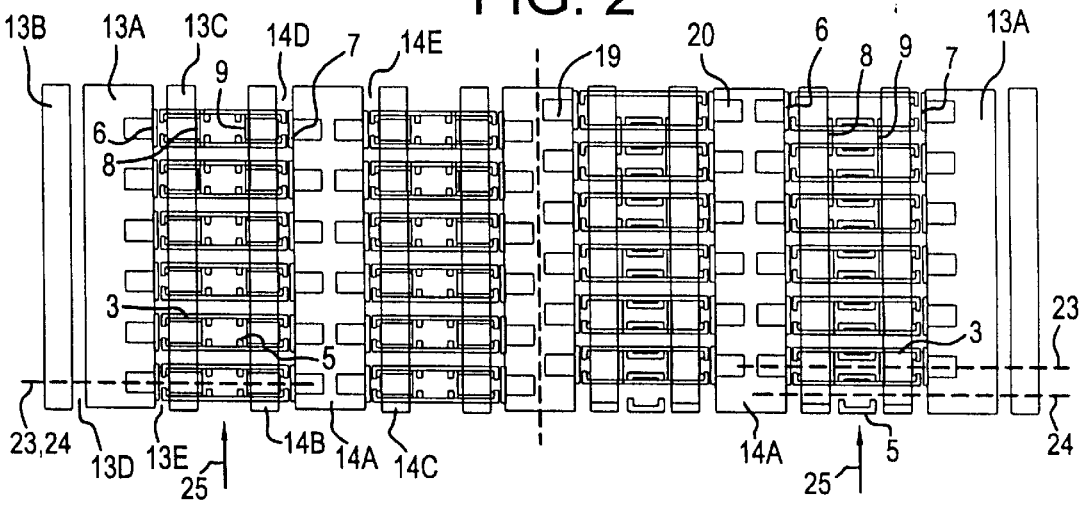
FIG. 2 represents a schematic view from above of the selection system from FIG. 1, in which two different arrangements (separated by the vertical dashed line) can be seen.
Figure 3:
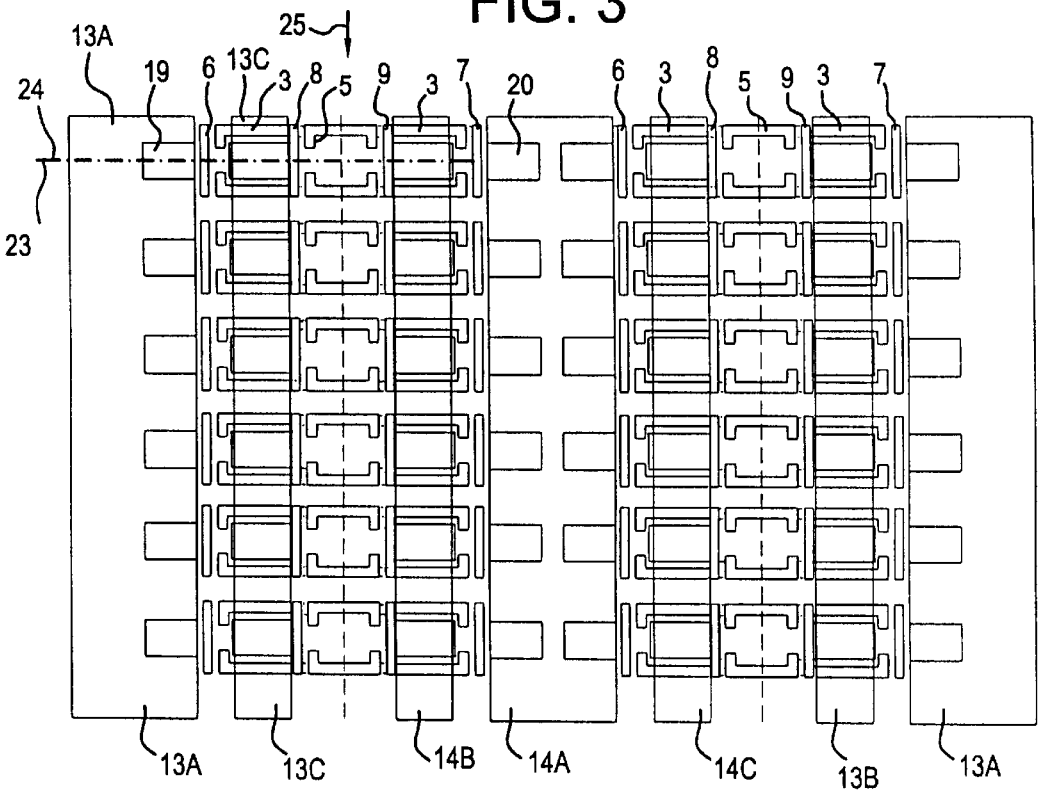
FIG. 3 is an enlarged representation of the arrangement that can be seen in FIG. 2 left of the dashed line.
Figure 4:
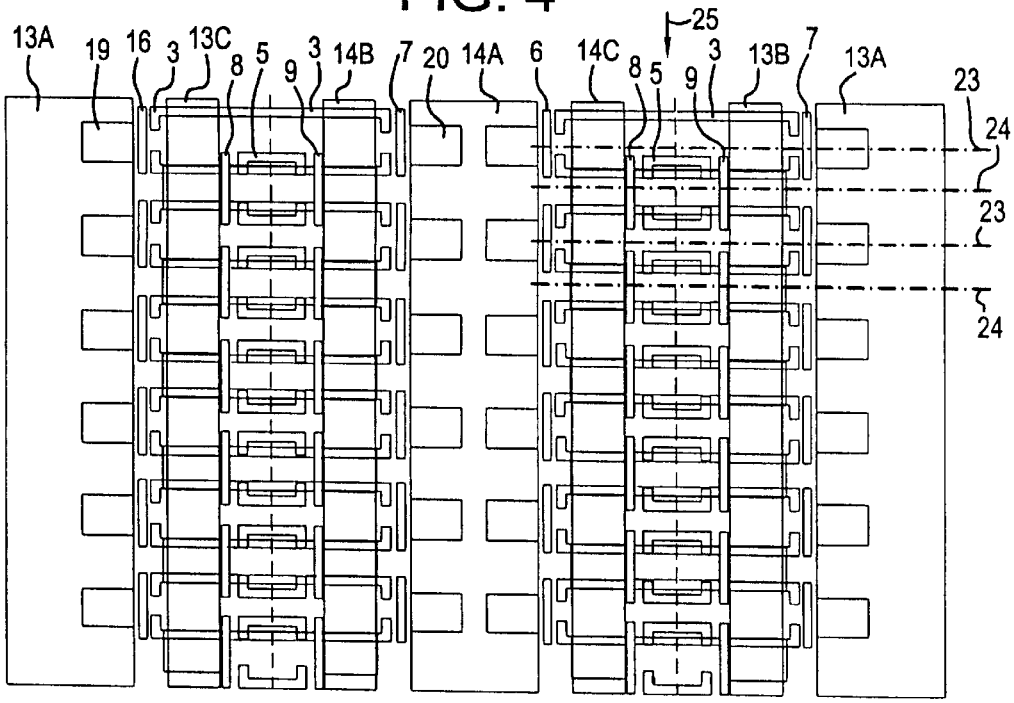
FIG. 4 is an enlarged representation of the arrangement that can be seen in FIG. 2 right of the dashed line.

The combinations of two selection systems with selection elements (3), (5) disposed one above the other are disposed in a row next to each other. Moreover the top (3) and the bottom selection element (5) of each combination can be so disposed that their vertical planes of symmetry (23), (24), which are perpendicular to the direction of the row, converge. The direction of the row is indicated in FIGS. 2, 3 and 4 with an arrow (25). In the left half of the device represented in FIG. 1 the selection elements are disposed in this manner. This appears from the view from above thereof (see FIG. 2: the part left of the vertical dashed line, and FIG. 3).

Another arrangement of the selection elements (see FIG. 2: right of the vertical dashed line, and FIG. 4) is that whereby the top (3) and the bottom selection element (5) of each combination are so disposed that their vertical planes of symmetry (23), (24) that are perpendicular to the direction of the row (arrow 25) are shifted in relation to each other according to the direction of the row, so that the top (3) and the bottom selection elements (5) are disposed shifted. The hooks (6), (7) that can be selected by the top (3) selection elements are then also disposed shifted in relation to the hooks (8), (9) that can be selected by the bottom selection elements (5).

In each combination of two selection systems there are four hooks (6–9) of which two work together with one selection system and two with the other selection system (see FIGS. 5 through 12). The two hooks working together are in each case connected to each other by means of a pulley cord (26), (27).

Each selection system works together with a pulley element (28), (29) consisting of a body with two rotating pulleys (a, b), (c, d) disposed one above the other. The pulley cord (26), (27) that connects the two hooks for that purpose runs under the top pulley (a), (c) of the pulley element (28), (29) so that this pulley element hangs in the down-hanging pulley cord loop.

With the embodiments according to FIGS. 5 through 8 over the bottom pulley (b), (d) of each pulley element (28), (29) a second pulley cord (30), (31) is run, of which one extremity is connected to a fixed part (32) of the device and the other extremity is connected to a harness cord (not represented in the figures) for influencing the position of one or several warp yarns on a weaving machine. Through a suitable selection of the hooks (6–9) the warp yarns can be brought into two different positions according to the open-shed principle. Each selection system here therefore works together with a two-position pulley device.

With the embodiments from FIGS. 5 and 6 the pulley elements (28), (29) that work together with the same combination of selection systems are suspended one below the other. Either the long hooks (6), (7) work together with the top pulley element (28) while the two short hooks (8), (9) work together with the bottom pulley element (29) (FIG. 5), or a long (6), (7) and a short hook (8), (9) work together with each pulley element (28), (29) (FIG. 6). The pulleys (a, b) of the top pulley element (28) have a smaller diameter than the pulleys of the bottom pulley element (29) so that the pulley of the two pulley devices (26, 31), (27, 30) are sufficiently far apart from each other.

Figure 7:
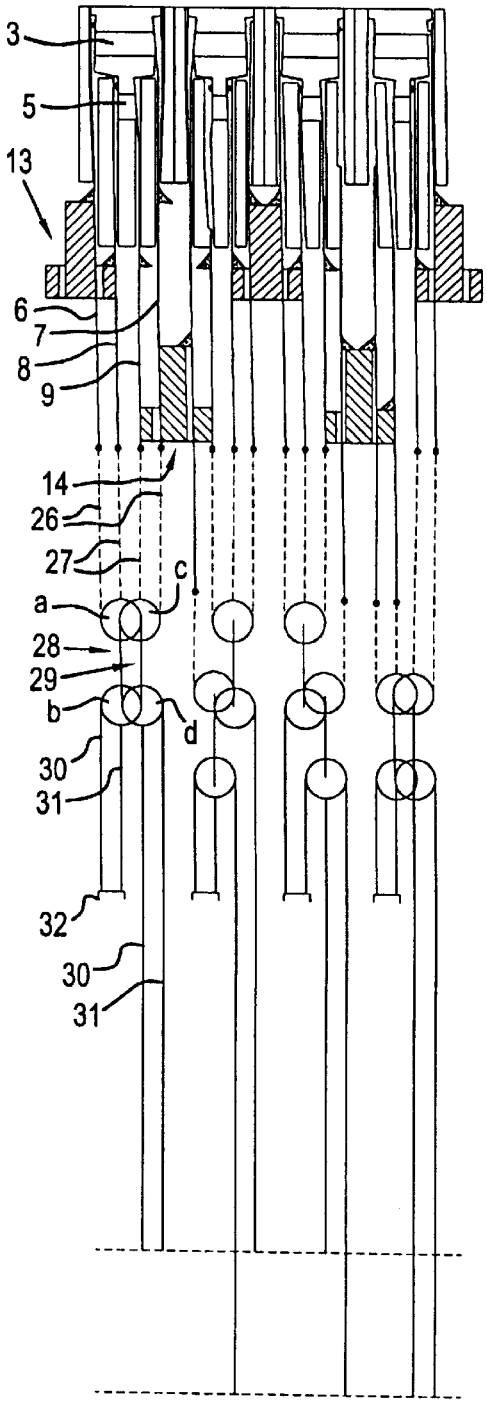
Figure 8:
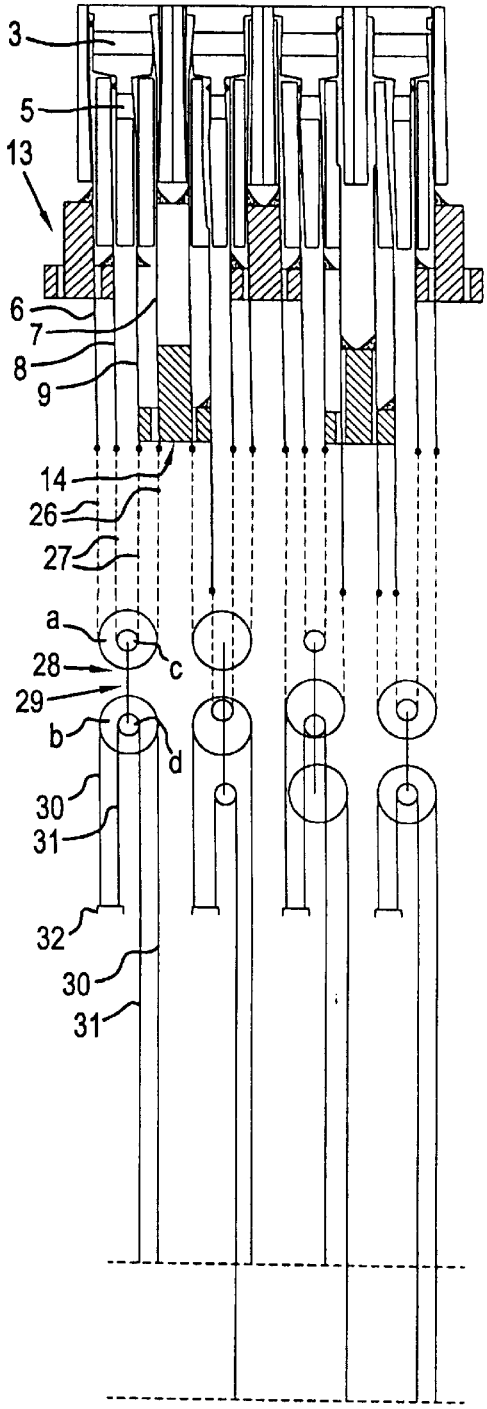

With the embodiments from FIGS. 7 and 8 the pulley elements (28), (29) that work together with the same combination of selection systems are suspended next to each other. Either the long hooks (6), (7) work together with the top pulley element (28) while the two short hooks (8), (9) work together with the bottom pulley element (29) (FIG. 8), or a long (6), (7) and a short hook (8), (9) work together with each pulley element (28), (29) (FIG. 7). With the embodiment according to FIG. 8 the pulleys (c, d) of one pulley element (29) have a smaller diameter than the pulleys (a, b) of the other pulley element (28).

With the embodiments according to FIGS. 9 through 12 the two selection systems of each combination work together with a three-position pulley device, which is provided because of the fact that a pulley cord (33) is connected by one extremity to a fixed part (32) of the device, is connected by the other extremity (34) to a harness cord for influencing the position of one or several warp yarns on a weaving machine, and between the two successively runs over the bottom pulley (d) of one pulley element (29), under a reversing pulley (e), and over the bottom pulley (b) of the other pulley element (28).

Through a suitable selection of the hooks of the two selection systems the warp yarns can be brought into three different positions according to the open-shed principle. Both selection systems of each combination here therefore work together with a three-position pulley block device.

Figure 9:
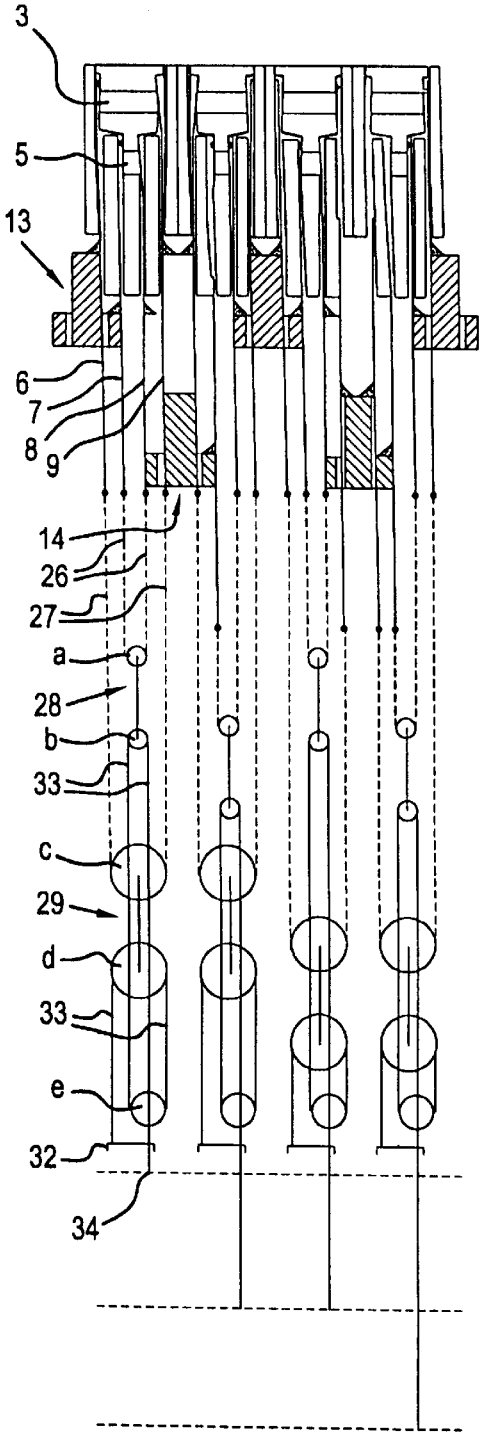
FIGS. 9 through 12 each represent a schematic side elevation of combinations of two selection systems that are provided in order to work together with a pulley block device in order to bring warp yarns into three different positions, whereby each figure represents a different embodiment.
Figure 10:
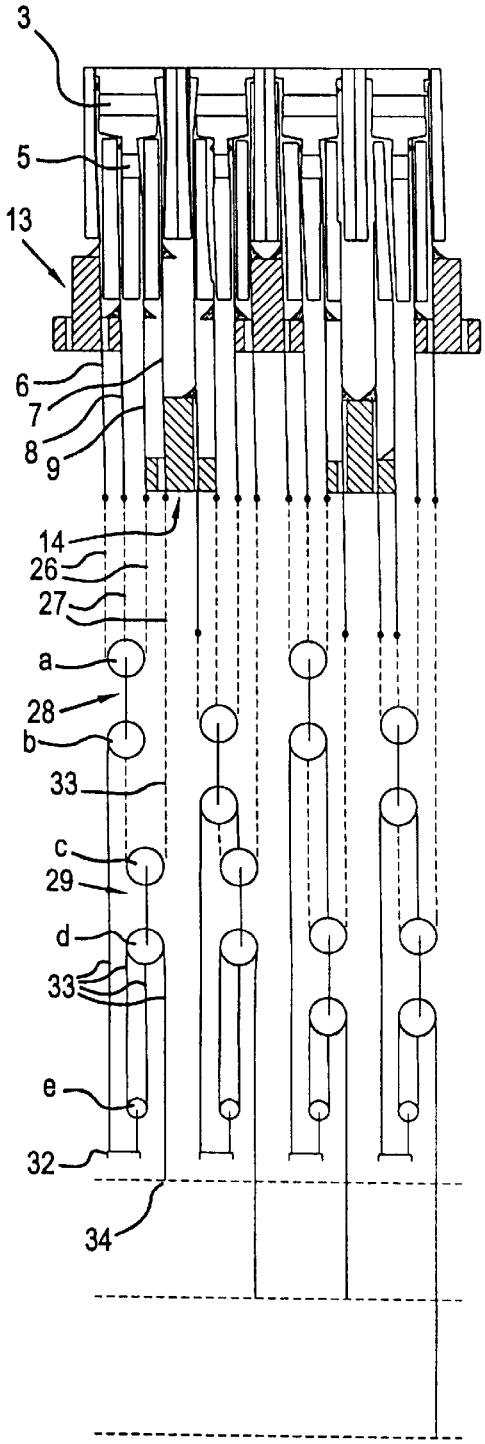

With the embodiments from FIGS. 9 and 10 the pulley elements (28), (29) that work together with the same combination of selection systems are suspended one below the other. Either the long hooks (6), (7) work together with the bottom pulley element (29) while the two short hooks (8), (9) work together with the top pulley element (28) (FIG. 9), or a long (6), (7) and a short hook (8), (9) work together with each pulley element (28), (29) (FIG. 10). In FIG. 9 the pulleys (a), (b) of the top pulley element (28) have a smaller diameter than the pulleys (c), (d) of the bottom pulley element (29) and the reversing pulley (e) so that the (parts of) pulley cords (26), (27), (33) running next to each other are sufficiently far apart. With the embodiment according to FIG. 10 the pulley elements (28), (29) have equal pulley diameters but the reversing pulleys (e) have smaller diameters.

Figure 11:
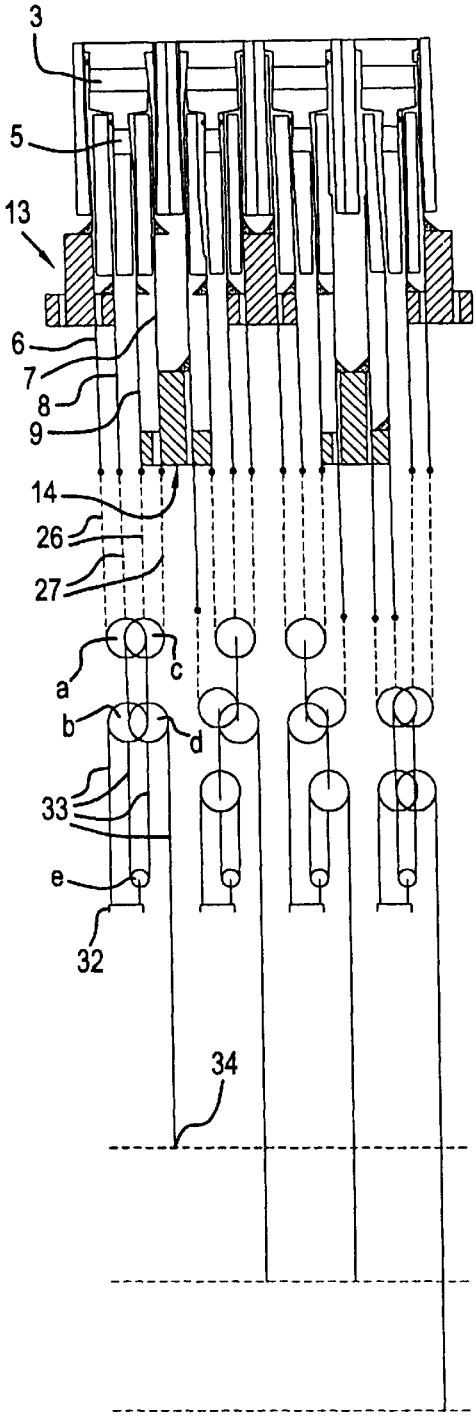
Figure 12:
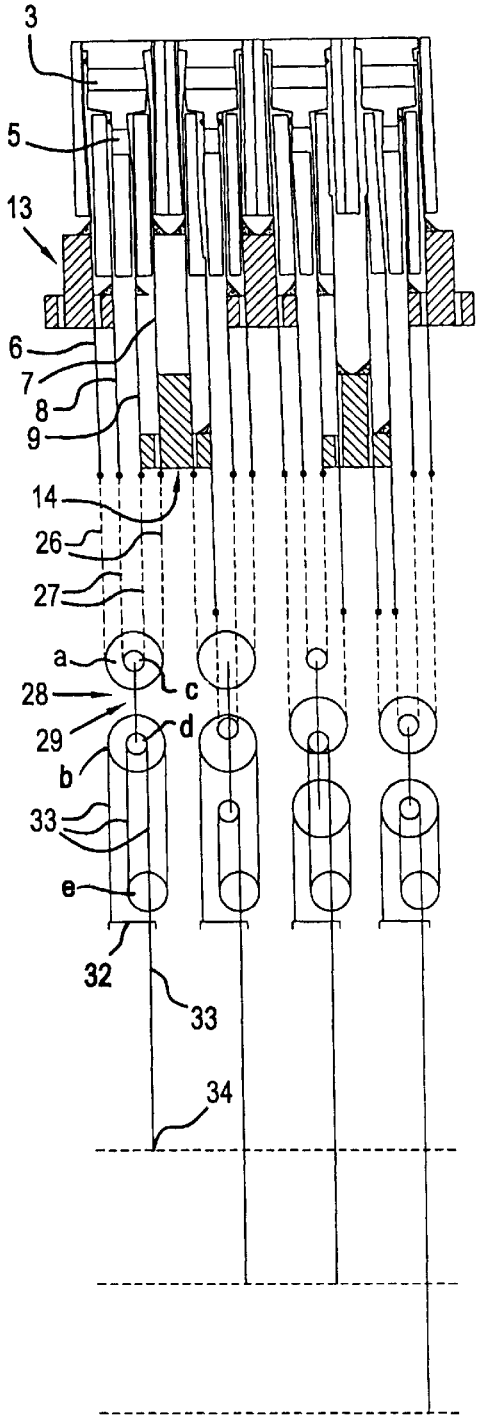

With the embodiments from FIGS. 11 and 12 the pulley elements (28), (29) that work together with the same combination of selection systems are suspended next to each other. Either the long hooks (6), (7) work together with one pulley element (28) while the two short hooks (8), (9) work together with the other pulley element (29) (FIG. 12), or a long (6), (7) and a short hook (8), (9) work together with each pulley element (28), (29) (FIG. 11). With the embodiment according to FIG. 12 the pulleys (c, d) of one pulley element (29) have a smaller diameter than the pulleys (a, b) of the other pulley element (28) and the reversing pulley (e). With the embodiment according to FIG. 11 the pulley diameters of the two pulley elements (28), (29) are equal but the reversing pulley (e) has a smaller diameter.

In order to prevent the various pulley cords from coming into contact with each other or impeding each other various arrangements for the pulley elements (28), (29) and possible reversing pulley (e) are possible. For a device with two-position pulley devices a number of possibilities are represented in FIGS. 13 through 16.

Figure 13:
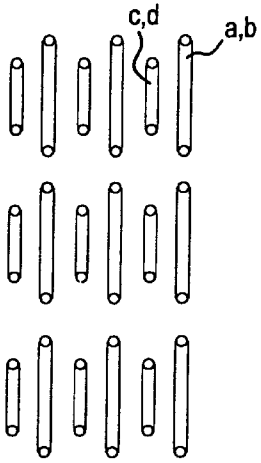
FIGS. 13 through 16 represent a schematic view from above of a possible arrangement of the pulley blocks with combinations of two selection systems respectively with two-position pulley block devices, whereby each figure represents a different arrangement.
Figure 14:
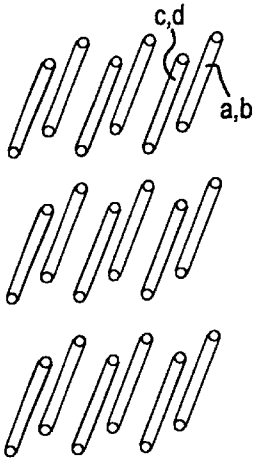
Figure 15:
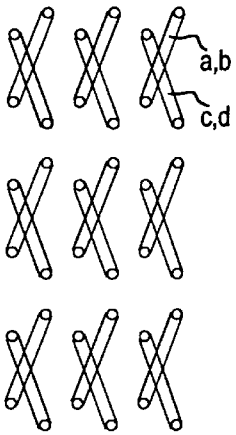
Figure 16:
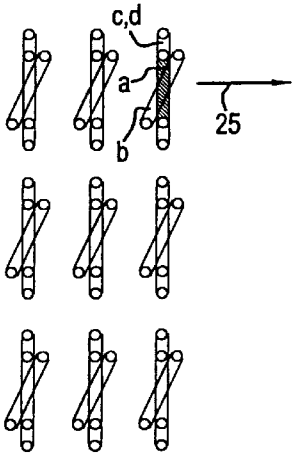

The shed-forming device comprises one or several rows with combinations of two selections systems disposed next to each other. Each selection system can moreover work together with a respective two-position pulley device as represented in FIGS. 5 through 8. If the top and the bottom selection systems of these combinations are disposed shifted according to the direction (25) of the row the long (6), (7) and the short hooks (8), (9) are also shifted so that the pulley elements (28), (29) can be suspended from these hooks in positions as represented in FIGS. 13 through 15. With the arrangement according to FIG. 16 the selection systems and the accompanying hooks are not disposed shifted.

The arrangement with pulley elements (28), (29) suspended next to each other with respective operating planes that are perpendicular to the direction (25) of the row (according to FIG. 13) and with selection elements disposed shifted, is shown by the device according to FIG. 8.

The arrangement with pulley elements suspended next to each other with respective operating planes that are oblique in relation to the direction of the row (according to FIG. 14) and with selection elements disposed slanted, is shown by the device according to FIG. 7.

With the device according to FIG. 6 a pulley element arrangement is shown with operating planes directed obliquely and intersecting each other (according to FIG. 15). The pulley elements (28), (29) here hang one below the other, while the selection elements (3), (5) are disposed shifted.

Figure 5:
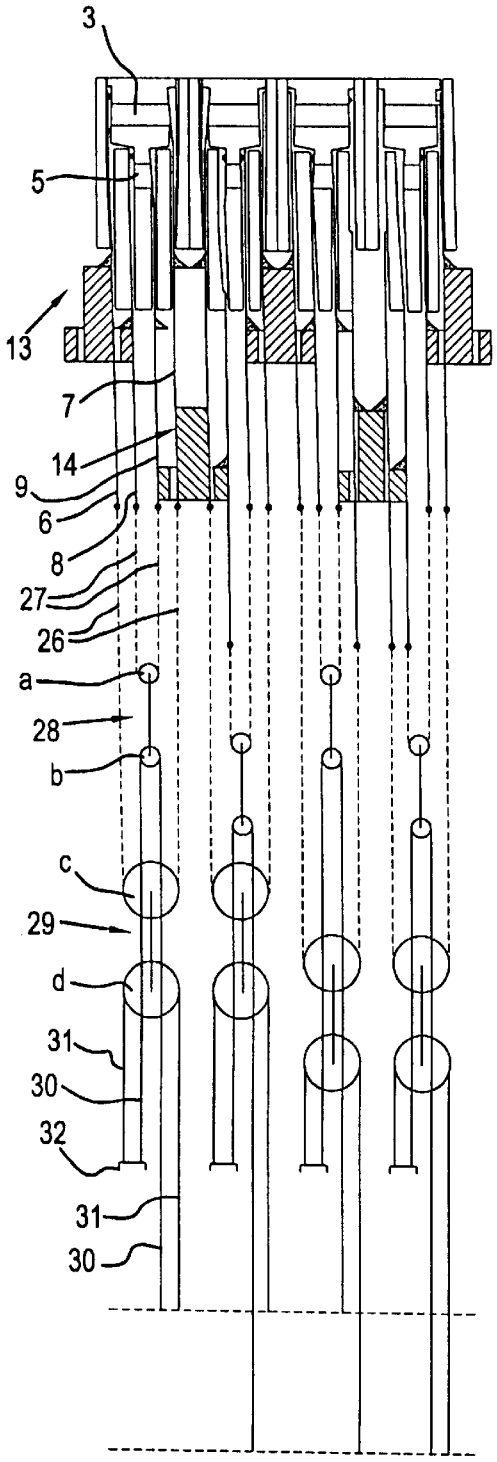
FIGS. 5 through 8 each represent a schematic side elevation of combinations of two selection systems that are provided with a respective pulley block device for bringing warp yarns into two positions, whereby each figure represents a different embodiment.
Figure 6:
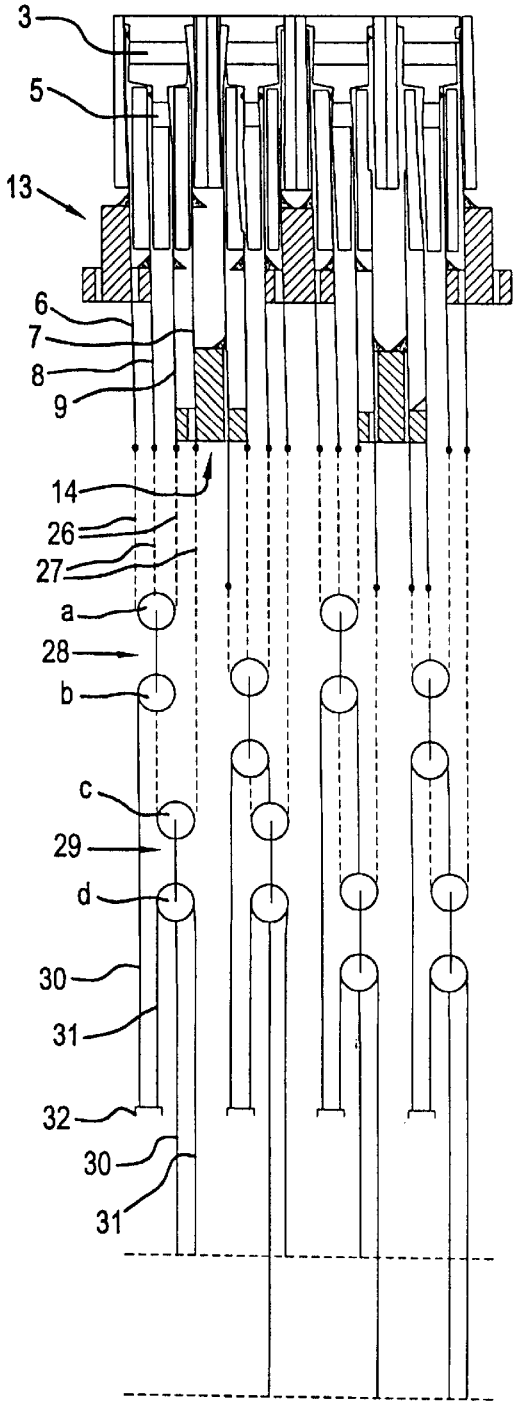

With the device according to FIG. 5 a pulley element arrangement is shown (according to FIG. 16) whereby the operating plane of the bottom pulley (b) of the top pulley element (28) is oblique in relation to the direction of the row (25) and in relation to the other pulleys (a), (c), (d). The pulley elements (28), (29) here hang one under the other and the selection elements (3), (5) are not shifted.

For a device with three-position pulley devices a number of possibilities are represented in FIGS. 17 through 20.

The arrangement with pulley elements (28), (29) suspended next to each other with respective operating planes that are perpendicular to the direction of the row (according to FIG. 17) is shown with the device according to FIG. 12. The pulley (e) is then of course oblique in relation to the direction (25) of the row. A pulley cord that comes from one pulley element (28) indeed runs via the reversing pulley (e) to the other pulley element (29), and must therefore be brought from one to the other operating plane on the reversing pulley (e).

The arrangement with pulley elements (28), (29) suspended next to each other with respective parallel operating planes that are oblique to the direction (25) of the row (according to FIG. 18), and whereby the pulley (e) of course again connects the two operating planes, is shown with the shed-forming device according to FIG. 11.

The arrangement with pulley elements (28), (29) suspended one below the other with operating planes obliquely directed and intersecting each other that are connected to each other by the pulley (e) is shown with the device that is represented in FIG. 10.

Figure 20:
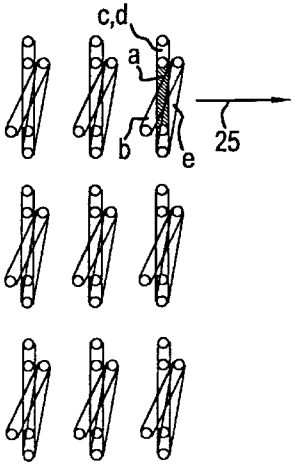

With the device according to FIG. 9 the pulley elements (28), (29) are best suspended in the positions that are represented in FIG. 20. The bottom pulley (b) of the top pulley element (28) here is disposed with an operating plane that is oblique in relation to the direction (25) of the row and in relation to the operating planes of the other pulleys (a), (c), (d). The reversing pulley (e) connects the oblique operating plane to the other operating planes.

Figure 17:
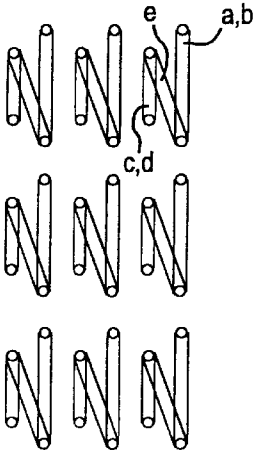
FIGS. 17 through 20 represent a schematic view from above of a possible arrangement of the pulley block elements and a reversing pulley with combinations of two selection systems that work together with a three-position pulley block device, whereby each figure represents a different arrangement.
Figure 18:
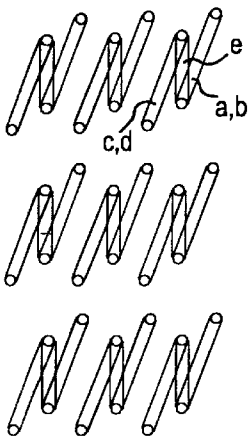
Figure 19:
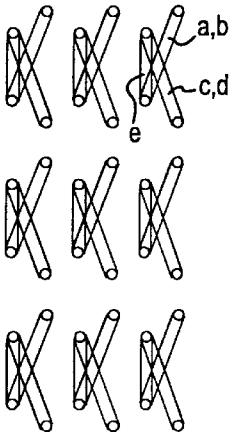

With the arrangements according to FIGS. 17, 18 and 19 the selection elements (3), (5) disposed one below the other are disposed shifted. With the arrangement according to FIG. 20 this is not the case.

We claim:

1. Shed-forming device for a weaving machine, comprising a number of combinations of at least two selection systems respectively with selection elements provided one above the other, whereby each selection system comprises two hooks (6), (7); (8), (9) working together and that can be moved up and down by lifting means (13), (14), which can be selected by a selection element (3), (5) so that they are held at a fixed height, characterized in that the hooks of different selection systems of the combinations are adapted for being moved up and down separately from each other.

2. Shed-forming device for a weaving machine, according to claim 1 characterized in that the hooks (6–9) of selection systems of a same combination are movable by one and the same pair of lifting means (13), (14) and that each lifting means comprises at least two parts for engaging a respective hook of a different selection system of the same combination.

3. Shed-forming device according to claim 2 characterized in that the aforesaid parts of each lifting means (13), (14) are provided at least at two different levels.

4. Shed-forming device according to claim 1 characterized in that each lifting means (13), (14) comprises a passage (13D), (13E); (14D), (14E) through which hooks can traverse the lifting means.

5. Shed-forming device according to claim 1 characterized in that the device comprises at least one row of several combinations of two selection systems disposed next to each other, and that the top (3) and the bottom selection elements (5) are disposed mutually shifted according to the direction (25) of the row.

6. Shed-forming device according to claim 1 characterized in that each combination comprises a top (3) and a bottom selection element (5) with two opposite selection flanks for the selection of respective hooks (6), (7); (8), (9), and that the selection flanks of the bottom selection element (5) lie closer together than the selection flanks of the top selection element (3).

7. Shed-forming device according to claim 1 characterized in that each selection system (3, 6, 7), (5, 8, 9) is provided with a number of combinations in order to bring warp yarns into two different positions.

8. Shed-forming device according to claim 1 characterized in that a number of combinations comprise two selection systems (3, 6, 7), (5, 8, 9) that are provided in order to work together so that they can bring warp yarns into three different positions.

9. Shed-forming device according to claim 1 characterized in that each combination comprises two selection systems (3, 6, 7), (5, 8, 9) with a respective pair of hooks (6, 7), (8, 9) working together, that these hooks can be engaged by two lifting means (13), (14) capable of moving up and down in opposite phase, and that each lifting means (13), (14) comprises a top (13A), (14A) and a bottom engagement means (13B), (13C); (14B), (14C) for engaging a respective hook of a different pair of hooks (6, 7), (8, 9) working together of a same combination.

10. Shed-forming device according to claim 1 characterized in that the device comprises at least one row of several combinations of selection systems (3, 6, 7), (5, 8, 9) disposed next to each other, and that the lifting means (13), (14) working together with these selection systems are provided in order to engage hooks of two combinations disposed next to each other.

11. Shed-forming device according to claim 1 characterized in that the device comprises at least one row of several combinations of selection systems (3, 6, 7), (5, 8, 9) disposed next to each other, of which each selection system comprises at least one pulley element (28), (29) working together with the hooks, and that the pulley elements (28), (29) of the selection systems that belong to a same combination are suspended next to each other or one below the other, whereby the operating planes of the pulleys (a, b), (c, d) of these pulley elements (28), (29) are mutually parallel and are either transverse to the direction (25) of the row or are oblique in relation to this direction (25).

12. Shed-forming device according to claim 1 characterized in that the device comprises at least one row of several combinations of selection systems (3, 6, 7), (5, 8, 9) disposed next to each other, of which each selection system comprises at least one pulley element (28), (29) working together with the hooks, and that the operating planes of at least two pulleys (a), (b), (c), (d) that belong to a same combination intersect each other.

13. Shed-forming device for a weaving machine, according to claim 1 further comprising an electronically controlled jacquard machine having the shed-forming device.

14. Shed-forming device according to claim 1, further comprising a weaving machine having the shed-forming device.

* * * * *